US008123840B2

(12) United States Patent
Marra

(10) Patent No.: US 8,123,840 B2
(45) Date of Patent: Feb. 28, 2012

(54) ELECTROSTATIC PARTICLE FILTER

(75) Inventor: Johan Marra, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 553 days.

(21) Appl. No.: 12/373,758

(22) PCT Filed: Jul. 9, 2007

(86) PCT No.: PCT/IB2007/052673

§ 371 (c)(1),
(2), (4) Date: Jan. 14, 2009

(87) PCT Pub. No.: WO2008/010137

PCT Pub. Date: Jan. 24, 2008

(65) Prior Publication Data

US 2010/0011959 A1 Jan. 21, 2010

(30) Foreign Application Priority Data

Jul. 19, 2006 (EP) ..... 06117448

(51) Int. Cl.
*B03C 3/016* (2006.01)

(52) U.S. Cl. ..... 96/16; 95/59; 96/69; 96/88

(58) Field of Classification Search ..... 96/16, 66–69, 96/88, 98, 99; 95/59
See application file for complete search history.

(56) References Cited

U.S. PATENT DOCUMENTS

| | | | | |
|---|---|---|---|---|
| 2,875,845 | A * | 3/1959 | Penney | 96/85 |
| 4,509,958 | A * | 4/1985 | Masuda et al. | 96/60 |
| 5,330,559 | A | 7/1994 | Cheney et al. | |
| 5,403,383 | A | 4/1995 | Jaisinghani | |
| 5,466,279 | A | 11/1995 | Hattori et al. | |
| 5,474,599 | A * | 12/1995 | Cheney et al. | 96/55 |
| 5,549,735 | A | 8/1996 | Coppom | |
| 6,187,271 | B1 * | 2/2001 | Lee et al. | 422/121 |
| 6,241,810 | B1 * | 6/2001 | Wikstrom et al. | 96/69 |
| 6,251,171 | B1 * | 6/2001 | Marra et al. | 96/69 |
| 6,514,324 | B1 * | 2/2003 | Chapman | 96/67 |

(Continued)

FOREIGN PATENT DOCUMENTS

| | | | | |
|---|---|---|---|---|
| JP | 53-112578 A * | 10/1978 | | 96/66 |

(Continued)

*Primary Examiner* — Richard L Chiesa
(74) *Attorney, Agent, or Firm* — Larry Liberchuk

(57) ABSTRACT

The invention relates to an electrostatic particle filter for removing particles from air. The electrostatic particle filter includes a filter medium (3) with first and second opposite sides, a first electrode (1) and a second electrode (2), the first electrode (1) and second electrode (2) being conformally provided on the first and second sides of the filter medium (3), respectively. The first electrode (1), the second electrode (2), and the filter medium (3) are arranged to allow an electrical conduction current through the filter medium (3). The first electrode (1) is a moderately-conductive electrode having a sheet resistance in a range with a lower boundary value of about $10^6$ Ohm per square and an upper boundary value of about $10^{12}$ Ohm per square, at a relative humidity of 30%. The invention also relates to an electrostatic filtration system including the electrostatic particle filter, and a particle charging section (6).

12 Claims, 4 Drawing Sheets

U.S. PATENT DOCUMENTS

| | | | | |
|---|---|---|---|---|
| 6,749,669 | B1 * | 6/2004 | Griffiths et al. | 96/67 |
| 6,764,533 | B2 * | 7/2004 | Lobiondo, Jr. | 96/66 |
| 6,955,708 | B1 * | 10/2005 | Julos et al. | 95/59 |
| 7,160,363 | B2 * | 1/2007 | Kulmala et al. | 96/67 |
| 2004/0226448 | A1 | 11/2004 | Griffiths et al. | |
| 2005/0045036 | A1 * | 3/2005 | Vetter et al. | 96/66 |
| 2006/0137527 | A1 | 6/2006 | Joannou | |

FOREIGN PATENT DOCUMENTS

| | | | |
|---|---|---|---|
| JP | 58092471 | A | 6/1983 |
| WO | 9316807 | A1 | 9/1993 |
| WO | 9533570 | A1 | 12/1995 |
| WO | 9624437 | A1 | 8/1996 |
| WO | 03084665 | A1 | 10/2003 |

* cited by examiner

ELECTROSTATIC PARTICLE FILTER

FIELD OF THE INVENTION

The invention relates to an electrostatic particle filter for removing particles from air, the electrostatic particle filter comprising a filter medium with first and second opposite sides, a first electrode and a second electrode, the first electrode and the second electrode being permeable for an air flow containing particles, and the first electrode and the second electrode being conformally provided on the opposite sides of the filter medium, respectively. The invention also relates to an electrostatic filtration system comprising an electrostatic particle filter, and a particle charging section.

BACKGROUND OF THE INVENTION

An electrostatic air filter for use in removing particles from air is known from U.S. Pat. No. 5,549,735. The known electrostatic air filter comprises a filter medium, an electrode pair including an insulated electrode and a non-insulated electrode positioned on opposite sides of the filter medium. Electrostatic augmentation of the filtration efficiency is realized by applying a potential difference between the electrodes positioned on opposite sides of the filter medium. The insulated electrode is prepared by a method that is known in the art, such as dipping or spraying a wire or a stamped metal strand, extruding or injection moulding an insulator simultaneously with a wire, and piecing together injection-moulded insulator halves around a wire. The purpose of the insulated electrode is to prevent establishment of a conductive path between the insulated electrode and the noninsulated electrode through the filter medium, such as to prevent electric arcing between the electrodes when a high electric field is established within the filter medium.

The inventors of the present invention have realized that the known electrostatic air filter can exhibit a rapid decrease in filtration efficiency during operation.

SUMMARY OF THE INVENTION

It is an object of the invention inter alia to provide an electrostatic particle filter of the kind set forth in the opening paragraph which is efficient, and maintains, or at least substantially maintains, its efficiency for a prolonged period of time during operation.

According to the invention, this object is realized in that the first electrode, the second electrode, and the filter medium are arranged to allow an electrical conduction current through the filter medium, and the first electrode is a moderately-conductive electrode having a sheet resistance in a range with a lower boundary value of about $10^6$ Ohm per square and an upper boundary value of about $10^{12}$ Ohm per square, at a relative humidity of 30%.

Typically, an electrostatic particle filter is part of an air cleaner, an air handling system, or an air conditioning system, that can for instance be used in a building or in a vehicle. Alternatively, such an electrostatic particle filter can also be part of a portable personal air cleaner consisting for instance of an air cleaning unit comprising the electrostatic particle filter, and an inhalation mask for enclosing a user's mouth and nose, the mask being connected to the air cleaning unit.

The filtration efficiency of an electrostatic particle filter comprising a first electrode, a second electrode, and a filter medium is positively dependent on the magnitude of an electric field existing within the filter medium. The electric field results from the application of a potential difference between the first electrode and the second electrode. Because the known electrostatic particle filter comprises an electrically-insulated electrode, the potential difference between the first electrode and the second electrode will be divided over the insulation material and the filter medium. When the filter medium has an electrical resistance substantially smaller than that of the insulation material, the potential difference between the first electrode and the second electrode will drop predominantly over the insulation material, and the magnitude of the electric field within the filter medium will be low, resulting in a poor electrostatic augmentation of the filtration efficiency. The electrical resistance of the filter medium can decrease during operation due to collection of particles, particularly electrically-conductive particles such as particles from cigarette smoke or soot, or due to absorption of water from the environment. In the electrostatic particle filter according to the invention, the first electrode, the second electrode, and the filter medium are arranged to allow an electrical conduction current through the filter medium. When present, the electrical conduction current flows from the first electrode 1, via the filter medium 3, to the second electrode 2, or vice versa. As a result, the potential difference between the first electrode and the second electrode will always drop predominantly over the filter medium, and will maintain a sufficient magnitude of the electric field within the filter medium, even if the filter medium possesses a finite electrical conductance. Consequently, the electrostatic particle filter according to the invention is efficient, and maintains, or at least substantially maintains, its efficiency for a prolonged period of time during operation.

When the first electrode, the second electrode, and the filter medium are arranged to allow an electrical conduction current through the filter medium, and when the first electrode and the second electrode both have a relatively high electrical conductance, a relatively large conduction current will flow through the filter medium in case it possesses a finite electrical conductance, resulting in an increased risk of electric arcing. Electric arcing could destroy the filter medium and poses a safety risk. In the electrostatic particle filter according to the invention, the first electrode is a moderately-conductive electrode, which, in the context of this invention, means that the first electrode has a sheet resistance in a range with a lower boundary value of about $10^6$ Ohm per square and an upper boundary value of about $10^{12}$ Ohm per square, at a relative humidity of 30%. The upper boundary value ensures that the moderately-conductive electrode can be electrically-charged within a sufficiently short time interval following the application of a potential difference between the first electrode and the second electrode. The lower boundary value ensures a sufficiently low magnitude of the electrical conduction current that will flow through the filter medium during operation in case the filter medium possesses a finite electrical conductance. Consequently, the electrostatic particle filter according to the invention has a low risk of electric arcing, and therefore a low safety risk.

An embodiment of the electrostatic particle filter according to the invention is defined in one embodiment as follows. In this embodiment, both the first electrode and the second electrode are moderately-conductive electrodes having a sheet resistance in a range with a lower boundary value of about $10^6$ Ohm per square and an upper boundary value of about $10^{12}$ Ohm per square, at a relative humidity of 30%. This embodiment even further reduces the electrical conduction current that will flow through an electrically-conductive path across the filter medium during operation, thereby extending the operational lifetime and reducing the safety risk even more.

An embodiment of the electrostatic particle filter according to the invention is defined as follows. In this embodiment, the lower boundary value of the sheet resistance of the moderately-conductive electrode is about $10^7$ Ohm per square and/or the upper boundary value of the sheet resistance of the moderately-conductive electrode is about $10^{11}$ Ohm per square, at a relative humidity of 30%. This embodiment better ensures that the moderately-conductive electrode is electrically-charged within a sufficiently short time interval following the application of a potential difference between the first electrode and the second electrode, and/or that the magnitude of the electrical conduction current that will flow through an electrically-conductive path across the filter medium during operation is sufficiently small, thereby extending the operational lifetime and reducing the safety risk even more.

An embodiment of the electrostatic particle filter according to the invention is defined as follows. In this embodiment, the lower boundary value of the sheet resistance of the moderately-conductive electrode is about $10^8$ Ohm per square and/or the upper boundary value of the sheet resistance of the moderately-conductive electrode is about $10^{10}$ Ohm per square, at a relative humidity of 30%. This embodiment even better ensures that the moderately-conductive electrode is electrically-charged within a sufficiently short time interval following the application of a potential difference between the first electrode and the second electrode, and/or that the magnitude of the electrical conduction current that will flow through an electrically-conductive path across the filter medium during operation is sufficiently small, thereby extending the operational lifetime and reducing the safety risk even more.

An embodiment of the electrostatic particle filter according to the invention is defined as follows. In this embodiment, the moderately-conductive electrode comprises an organic compound. An organic compound is particularly attractive in the context of this invention because it enables convenient manufacturing of inexpensive moderately-conductive electrodes. An electrode that comprises an organic compound has excellent mechanical properties such as flexibility, ductility, and strength, thereby enabling the electrode to be shaped together with the filter medium. Furthermore, by providing the filter medium with mechanical robustness, an electrode that comprises an organic compound allows the use of a filter medium that is difficult to shape by itself, such as a filter medium comprising a polyolefin.

An embodiment of the electrostatic particle filter according to the invention is defined as follows. In this embodiment, the organic compound is a hydrophilic organic compound. A hydrophilic organic compound is particularly attractive for manufacturing an electrode of which the electrical properties are to be determined by the combined use of a doping agent.

An embodiment of the electrostatic particle filter according to the invention is defined as follows. In this embodiment, the moderately-conductive electrode comprises a doping agent. This embodiment provides the moderately-conductive electrode with the possibility to independently optimize its mechanical properties and its electrical properties.

An embodiment of the electrostatic particle filter according to the invention is defined as follows. In this embodiment, the doping agent is a hydrophilic doping agent or a hygroscopic doping agent. Use of a hydrophilic doping agent or a hygroscopic doping agent in combination with an organic compound is particularly attractive in the context of this invention because it enables convenient manufacturing of moderately-conductive electrodes.

An embodiment of the electrostatic particle filter according to the invention is defined as follows. In this embodiment, the filter medium comprises a hydrophobic material. A filter medium comprising a hydrophobic material is very attractive as it has a high electrical resistivity, also at high relative humidity. However, a filter medium comprising a hydrophobic material, such as a polyolefin, can be difficult to shape by itself because of its very low stiffness. In this embodiment, the moderately-conductive electrode comprises an organic compound. Consequently, the moderately-conductive electrode has excellent mechanical properties such as flexibility, ductility, and strength, and enhances the mechanical robustness of the filter medium, thereby enabling the filter medium to be shaped together with the moderately-conductive electrode.

According to another embodiment, an electrostatic filtration system comprises a particle charging section and an electrostatic particle filter, the electrostatic particle filter comprising a filter medium with first and second opposite sides, a first electrode and a second electrode, the first electrode and the second electrode being permeable for an air flow containing particles, and the first electrode and the second electrode being conformally provided on the first and second opposite sides of the filter medium, respectively, characterized in that the first electrode, the second electrode, and the filter medium are arranged to allow an electrical conduction current through the filter medium, and the first electrode is a moderately-conductive electrode having a sheet resistance in a range with a lower boundary value of about $10^6$ Ohm per square and an upper boundary value of about $10^{12}$ Ohm per square, at a relative humidity of 30%.

An embodiment of the electrostatic particle filter according to the invention is defined as follows. In this embodiment, the doping agent is a photocatalyst. Upon irradiation with ultraviolet light, the moderately-conductive electrode that comprises the photocatalyst can photocatalytically oxidize noxious gaseous compounds passing through the filter thereby increasing the air cleaning efficiency of the electrostatic particle filter.

According to another embodiment, an electrostatic filtration system comprises a particle charging section, an electrostatic particle filter, and a light source. The electrostatic particle filter comprises a filter medium with first and second opposite sides, a first electrode and a second electrode, the first electrode and the second electrode being permeable for an air flow containing particles, and the first electrode and the second electrode being conformally provided on the first and second opposite sides of the filter medium, respectively, characterized in that the first electrode, the second electrode, and the filter medium are arranged to allow an electrical conduction current through the filter medium, and the first electrode is a moderately-conductive electrode having a sheet resistance in a range with a lower boundary value of about $10^6$ Ohm per square and an upper boundary value of about $10^{12}$ Ohm per square, at a relative humidity of 30%. The moderately-conductive electrode comprises a doping agent that is a photocatalyst, and the light source is arranged to produce ultraviolet radiation for irradiating the photocatalyst.

BRIEF DESCRIPTION OF THE DRAWINGS

These and other aspects of the electrostatic particle filter of the invention will be further elucidated and described with reference to the drawings, in which.

DETAILED EMBODIMENTS

Figure 1:
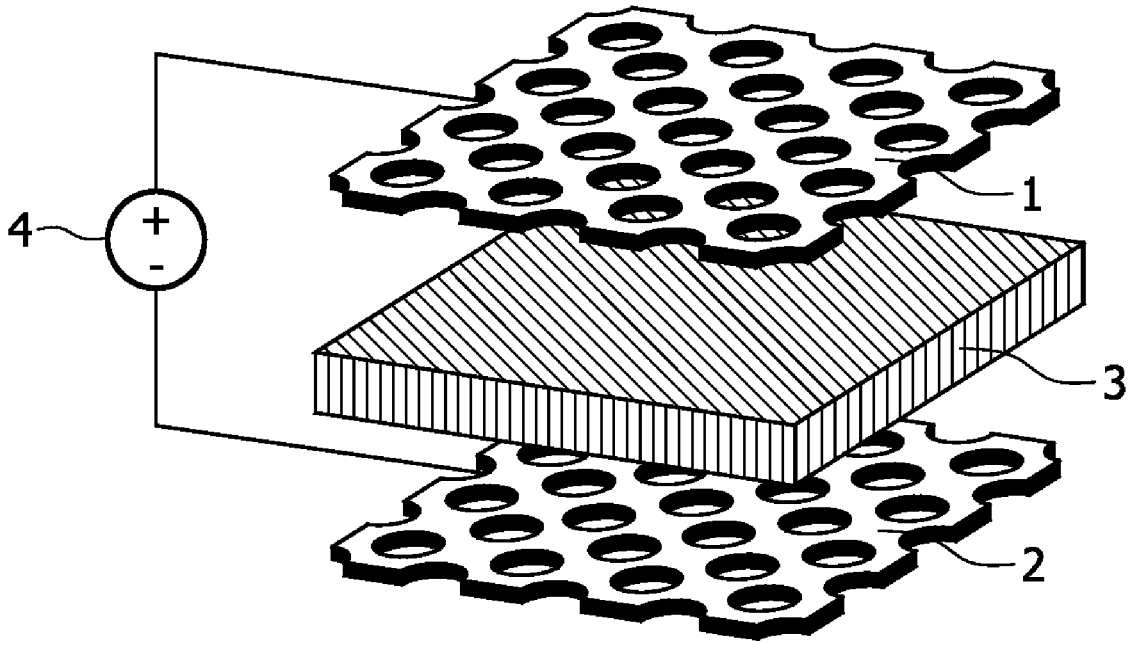
FIG. 1 is an exploded view of part of the electrostatic particle filter according to the invention.

The electrostatic particle filter of FIG. 1 comprises a first electrode 1, a second electrode 2, and a filter medium 3. FIG. 1 also shows a power supply 4 that is connected to the electrostatic particle filter. The first electrode 1 and the second electrode 2 typically have a thickness between 0.01 mm and 5 mm, or more specifically between 0.5 mm and 2 mm. The filter medium 3 typically has a thickness between 1 mm and 5 mm, or more specifically between 2 mm and 4 mm.

The first electrode 1 and the second electrode 2 are permeable for an air flow containing particles, particularly ultrafine particles. In the context of this invention, ultrafine particles are particles with an equivalent diameter between about 10 nm and about 2500 nm. Regarding the first electrode 1 and the second electrode 2, the person skilled in the art will understand that permeability for an air flow containing particles can be obtained in a variety of ways, for instance by using a perforated structure, a porous structure, a set of parallel tracks, a grid, a mesh, or a gauze. Regarding the filter medium 3, a variety of filter media are known in the art, for example a filter medium comprising fibers or a filter medium comprising open foam cells.

At a relative humidity of 30%, the filter medium 3 in its pristine state has an electrical resistivity as measured in a direction parallel to the surface normal of $10^8$ Ohm·m or higher, but preferably $10^9$ Ohm·m or higher. For example, the filter medium 3 is a fibrous filter medium of 3 mm thickness comprising a hydrophobic material. The hydrophobic material can be a hydrophobic synthetic resin such as a polyester, or a polyolefin, or it can be a hydrophobized glass. To manufacture a filter medium from a hydrophobic material is very attractive as the hydrophobic material ensures a high electrical resistivity of the filter medium, even at high relative humidity, by resisting the absorption of water.

The first electrode 1 and the second electrode 2 are conformally provided on the opposite sides of the filter medium 3, respectively. Provided that this condition is fulfilled, the electrostatic particle filter as a whole can have any shape, for example a folded shape or a pleated shape. For an electrostatic particle filter that has a folded shape or a pleated shape, it is desirable that the first electrode 1 and the second electrode 2 have excellent mechanical properties such as flexibility, ductility, and strength. This allows the first electrode 1 and the second electrode 2, while in contact with the filter medium 3, to be shaped together with the filter medium 3. Additionally, this allows the use of a filter medium that is difficult to shape by itself, as the first electrode 1 and the second electrode 2 provide the filter medium 3 with mechanical robustness.

The first electrode 1 is a moderately-conductive electrode. In the context of this invention, a moderately-conductive electrode refers to an electrode with a sheet resistance in a range with a lower boundary value of about $10^6$ Ohm per square and an upper boundary value of about $10^{12}$ Ohm per square, at a relative humidity of 30%. The sheet resistance of an electrode is the electrical resistance as measured between two opposite sides of a square, the square being oriented parallel to the electrode surface. The sheet resistance of an electrode is independent of the size of the square, and depends only on the thickness of the electrode and on the resisitivity of the material from which the electrode is manufactured. The upper boundary value ensures a sufficiently rapid electrical charging of the entire surface area of the moderately-conductive electrode, even at a relative humidity lower than 30%. The electrical charging is preferably completed within 10 s. The lower boundary value ensures a sufficiently low magnitude of the electrical conduction current that will flow through the filter medium 3 during operation in case the filter medium 3 possesses a finite electrical conductance, thereby limiting the electrical power consumption, and limiting the consequences associated with the presence of local short circuits between the electrode 1 and the electrode 2. Examples of such consequences are a safety risk, and a significant drop of the electric potential across a substantial part of the electrode surface. Consequently, the lower boundary value ensures that sufficient electrostatic augmentation of the filtration efficiency across a substantial part of the filter area is maintained under a variety of potentially adverse conditions.

Provided that the first electrode 1 is a moderately-conductive electrode that is permeable for an air flow containing particles, the first electrode 1 can comprise any material. A suitable material is an organic compound, particularly an organic compound with a high molecular weight, such as a polymer. Organic compounds are inexpensive materials that have excellent mechanical properties such as flexibility, ductility, and strength. Furthermore, a moderately-conductive electrode can easily be manufactured from an organic compound. For this purpose, one can either use an inherently moderately-conductive organic compound, or one can use any organic compound and use an additive to adjust the electrical properties. Such an additive will be referred to as a doping agent, without implying any restrictions as to the relative amount of additive used. An example of an organic compound that can be used to manufacture a moderately-conductive electrode is a synthetic resin. Inherently moderately-conductive synthetic resins are known in the art. An example of an inherently moderately-conductive synthetic resin is an inherently conductive polymer.

Doping agents are also known in the art. To add the doping agent to the organic compound, the person skilled in the art can use a standard method such as impregnation or coating, possibly using a binder and/or a surfactant to improve the impregnation or coating process.

An advantage of using a doping agent to adjust the electrical properties of an electrode comprising an organic compound is that the mechanical properties and the electrical properties of the electrode can be optimized independently. An electrode comprising an organic compound may comprise more than one type of doping agent.

An example of a doping agent is an intrinsically-conductive compound such as carbon black, that can be part of a blend such as a conductive ink. Another example of a doping agent is a semiconductive compound such as zinc sulfide (ZnS).

A preferred doping agent is a hydrophilic doping agent. Examples of hydrophilic doping agents are oxides (such as silicon dioxide ($SiO_2$), aluminum oxide ($Al_2O_3$), titanium dioxide ($TiO_2$), or indium tin oxide (ITO)), nitrides (such as silicon nitride ($Si_3N_4$)), hydroxides (such as magnesium hydroxide ($Mg(OH)_2$)), carbonates (such as magnesium carbonate ($MgCO_3$)), oxalates (such as calcium oxalate ($CaC_2O_4$)), sulfides, sulfates (such as calcium sulfate ($CaSO_4$)), phosphates (such as calcium phosphate ($Ca_3(PO_4)_2$)), or phosphonates. As the hydrophilic doping agent titanium dioxide ($TiO_2$), more particularly crystalline anatase titanium dioxide, is also a photocatalyst, the electrode comprising titanium dioxide is endowed with the added functionality of photocatalytic activity upon irradiation with ultraviolet light having a wavelength of about 450 nm or shorter. The photocatalytic activity involves the oxidation of noxious gaseous compounds passing through the filter, and it increases the air cleaning efficiency of the electrostatic particle filter as it enables the combined removal of particles and gaseous compounds from air. The hydrophilic doping agent titanium dioxide is preferably present at least on the electrode positioned at the downstream side of the filter medium 3 in order to prevent a rapid coverage of the titanium dioxide with particles that are deposited from the air flow.

Another preferred doping agent is a hygroscopic doping agent. Examples of inorganic hygroscopic doping agents are sodium carbonate ($Na_2CO_3$), sodium bicarbonate ($NaHCO_3$), potassium carbonate ($K_2CO_3$), potassium bicarbonate ($KHCO_3$), and potassium formate ($KHCO_2$). Examples of organic hygroscopic doping agents are urea ($CO(NH_2)_2$), citric acid ($COH(CH_2COOH)_2COOH$), tris(hydroxymethyl)aminomethane ($C(CH_2OH)_3NH_2$), and polyvinyl alcohol ($(CH_2CHOH)_n$).

The sheet resistance of an electrode that comprises an organic compound and a hydrophilic doping agent or a hygroscopic doping agent depends on the capability of the hydrophilic doping agent or the hygroscopic doping agent to bind water from its surroundings. A preferred combination of an organic compound and a hydrophilic doping agent or a hygroscopic doping agent comprises a hydrophilic synthetic resin such as a polyester or a polyamide.

An electrode that comprises an alkaline doping agent has the added functionality of removing noxious acidic gaseous compounds such as sulfur dioxide ($SO_2$), nitrous acid ($HNO_2$), nitric acid ($HNO_3$), and carboxylic acids from the environment, thereby increasing the air cleaning efficiency of the electrostatic particle filter as it enables the combined removal of particles and gaseous compounds from air. An electrode that comprises an acidic doping agent has the added functionality of removing noxious alkaline gaseous compounds such as ammonia ($NH_3$) and other amines from the environment, thereby increasing the air cleaning efficiency of the electrostatic particle filter as it enables the combined removal of particles and gaseous compounds from air. An electrode that comprises the organic hygroscopic doping agents urea and/or tris(hydroxymethyl)aminomethane has the added functionality of removing formaldehyde ($CH_2O$) from the environment, thereby increasing the filtration efficiency of the electrostatic particle filter. The use of polyvinyl alcohol as doping agent benefits from the known quality of polyvinyl alcohol to act as a binder in an impregnation process, increasing the overall amount of impregnation and resulting in a better attachment of the impregnants.

In addition to using a doping agent, one can also use other additives known in the art for improving the performance of the electrostatic particle filter. An example of such an additive is activated carbon. The first electrode 1, the second electrode 2, and/or the filter medium 3 can comprise activated carbon. The use of activated carbon adds the functionality of removing from the environment noxious gaseous compounds such as hydrocarbons and ozone, thereby increasing the air cleaning efficiency of the electrostatic particle filter as it enables the combined removal of airborne particles and gaseous compounds.

A method for impregnating an electrode comprising an organic compound with a doping agent is dip-coating the electrode using an aqueous solution comprising the doping agent. After immersing the electrode in the aqueous solution, the electrode is withdrawn from the aqueous solution at a speed of about 2 cm/s to about 20 cm/s. After withdrawing the electrode from the aqueous solution, the electrode is dried in ambient air or in heated air under forced convection. A first example of an aqueous solution comprises potassium bicarbonate (0.01 g/ml to 0.3 g/ml) and potassium formate (0.001 g/ml to 0.05 g/ml). This aqueous solution may also comprise tris(hydroxymethyl)-aminomethane (0.01 g/ml to 0.1 g/ml) and/or urea (0.01 g/ml to 0.1 g/ml). A second example of an aqueous solution comprises citric acid (0.01 g/ml to 0.4 g/ml) and/or phosphoric acid (0.01 g/ml to 0.25 g/ml). This aqueous solution may also comprise urea (0.05 g/ml to 0.15 g/ml). Both the first example of an aqueous solution and the second example of an aqueous solution may further comprise polyvinyl alcohol (0.005 g/ml to 0.05 g/ml) and/or a surfactant to improve the coating process.

The first electrode 1, the second electrode 2, the filter medium 3, and the power supply 4 are part of an electrical circuit that is arranged to allow an electrical conduction current through the filter medium 3 in response to a potential difference between the first electrode 1 and the second electrode 2 resulting from a voltage supplied by the power supply 4. When present, the electrical conduction current flows from the first electrode 1, via the filter medium 3, to the second electrode 2, or vice versa. Depending on the degree of pollution, the relative humidity, and the potential difference between the first electrode 1 and the second electrode 2 resulting from the voltage supplied by the power supply 4, the electrical conduction current can be in the mA range. However, based on safety considerations and on the capacity of the power supply 4, the electrical conduction current that is allowed to flow in the electrical circuit is limited to a set maximum value, for example 0.1 mA. As long as the electrical conduction current does not exceed the set maximum value, the filtration efficiency of the electrostatic particle filter according to the invention will be electrostatically augmented to a desired degree. At a very high relative humidity, the electrical conduction current may reach the set maximum value, thereby triggering a reduction of the voltage supplied by the power supply 4 in order to limit the electrical conduction current to the set maximum value. Under these circumstances, the degree of electrostatic augmentation of the filtration efficiency will be reduced.

The first electrode 1 and the second electrode 2 can each be connected to the power supply 4 in a variety of ways known to the person skilled in the art, provided that particles present in an air flow can penetrate into the filter medium 3. For example, an interconnect such as a metallization layer or a metal structure can be used. The metal structure should be in contact with the first electrode 1 or the second electrode 2 at one or more points along the surface of the first electrode 1 or the second electrode 2, respectively. The first electrode 1 and the second electrode 2 can each be connected to the filter medium 3 in a variety of ways known to the person skilled in the art, provided that particles present in an air flow can penetrate into the filter medium 3, and provided that the electrical circuit is arranged to allow an electrical conduction current through the filter medium 3. The latter prerequisite excludes the possibility that the first electrode 1 or the second electrode 2 is completely insulated within the electrical circuit, for example when the first electrode 1 or the second electrode 2 is manufactured by dipping or spraying a wire or a stamped metal strand, extruding or injection moulding an insulator simultaneously with a wire, and piecing together injection-moulded insulator halves around a wire. The latter prerequisite allows the use of an adhesive to connect the first electrode 1 or the second electrode 2 to the filter medium 3. An example of an adhesive is a resin glue, that can be dissolved in a volatile solvent and subsequently applied on a side of the filter medium 3 prior to laminating the first electrode 1 or the second electrode 2 on the side of the filter medium 3 that comprises the resin glue.

An additional advantage of the electrostatic particle filter according to the invention is that it conveniently enables monitoring of the ability of the electrostatic particle filter to realize a desired electrostatic augmentation of the filtration efficiency. In the electrostatic particle filter according to the invention, the first electrode 1, the second electrode 2, and the filter medium 3 are arranged to allow an electrical conduction current through the filter medium 3. The magnitude of the electrical conduction current is positively dependent on the amount of deposited particles inside the filter medium 3, particularly on the amount of deposited electrically-conductive particles such as particles from cigarette smoke or soot. The magnitude of the electrical conduction current is also positively dependent on the relative humidity, and on the potential difference between the first electrode 1 and the second electrode 2, resulting from the voltage supplied by the power supply 4. To guarantee safe operation of the electrostatic particle filter and to limit power consumption, the electrical conduction current is not allowed to exceed a set maximum value. The ability of the electrostatic particle filter to realize a desired electrostatic augmentation of the filtration efficiency can be monitored by measuring the magnitude of the electrical conduction current. When the electrical conduction current exceeds the set maximum value, the desired electrostatic augmentation of the filtration efficiency cannot be realized under safe operating conditions, and the voltage supplied by the power supply 4 has to be reduced in order to maintain the electrical conduction current at the set maximum value, resulting in a reduction of the electrostatic augmentation of the filtration efficiency. This could either mean that the end-of-filter lifetime has been reached due to a large amount of particles that have been deposited within the filter medium 3, or that the relative humidity is too high. By monitoring both the relative humidity, and the electrical conduction current in relation to the relative humidity and the voltage supplied by the voltage supply 4, the end-of-filter lifetime can be conveniently detected. The detection of the end-of-filter lifetime can for instance result in relaying a warning signal.

When the first electrode 1 and the second electrode 2 are conformally provided on the opposite sides of the filter medium 3, respectively, and when the first electrode 1, the second electrode 2, the filter medium 3, and the power supply 4 are part of an electrical circuit that is arranged to allow an electrical conduction current through the filter medium 3, a relatively small potential difference between the first electrode 1 and the second electrode 2 suffices to create a sufficiently strong electric field within the filter medium 3. For example, when the filter medium 3 has a thickness of 3 mm, a potential difference of 3 kV between the first electrode 1 and the second electrode 2 results in an electric field of 1 kV/mm within the filter medium 3, which is well below 3 kV/mm, being the magnitude of the electric field at which dielectric breakdown of air occurs. The potential difference between the first electrode 1 and the second electrode 2 can even be increased to 6 kV while still keeping the electric field within the filter medium 3 below the magnitude at which dielectric breakdown of air occurs. Consequently, the power supply 4 is arranged to supply a voltage between 0.1 kV and 10 kV, or more specifically between 1 kV and 5 kV. This means that the electrostatic particle filter according to the invention enables the use of a relatively inexpensive power supply 4, and reduces any high-voltage safety risk.

Figure 2:
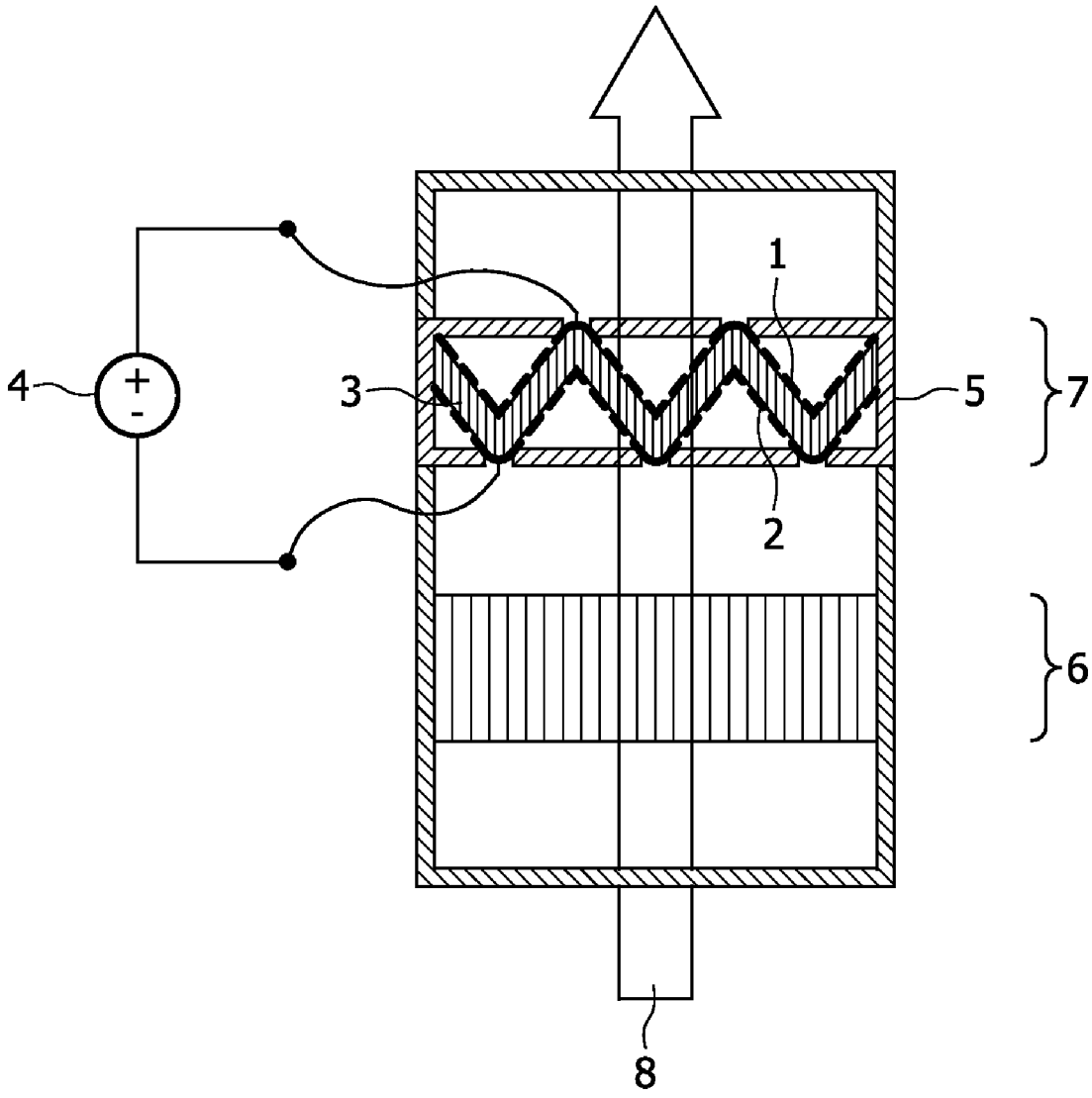
FIG. 2 is a cross section of an electrostatic filtration system comprising a particle charging section and a particle collection section, the particle collection section comprising the electrostatic particle filter according to the invention.

The electrostatic filtration system of FIG. 2 comprises a particle charging section 6, and a particle collection section 7. The arrow 8 in FIG. 2 indicates the direction of air flow through the electrostatic filtration system, and serves to indicate that the particle charging section 6 is positioned on the upstream side of the particle collection section 7. The particle charging section 6 is arranged to impart an electrical charge to particles that are present in the air flow in order to enhance the filtration efficiency. The electrically-charged particles are subsequently drawn into the particle collection section 7. The particle collection section comprises a first electrode 1, a second electrode 2, a filter medium 3, and a power supply 4 as described with reference to FIG. 1. Due to electrostatic interactions with the polarized filter medium 3, the electrically-charged particles are collected within the particle collection section 7.

The first electrode 1, the second electrode 2, and the filter medium 3 are enclosed in a casing 5. The casing 5 is permeable for an air flow containing particles and is constructed to allow the first electrode 1 and the second electrode 2 to be connected to the power supply 4. At the end of the operational lifetime of the electrostatic particle filter, the casing 5 comprising the electrostatic particle filter is removed from the electrostatic filtration system, discarded, and replaced by a new casing comprising a new electrostatic particle filter. The electrostatic particle filter being discardable, the first electrode 1, the second electrode 2, and the filter medium 3 should preferably be manufactured from inexpensive materials.

Figure 3:
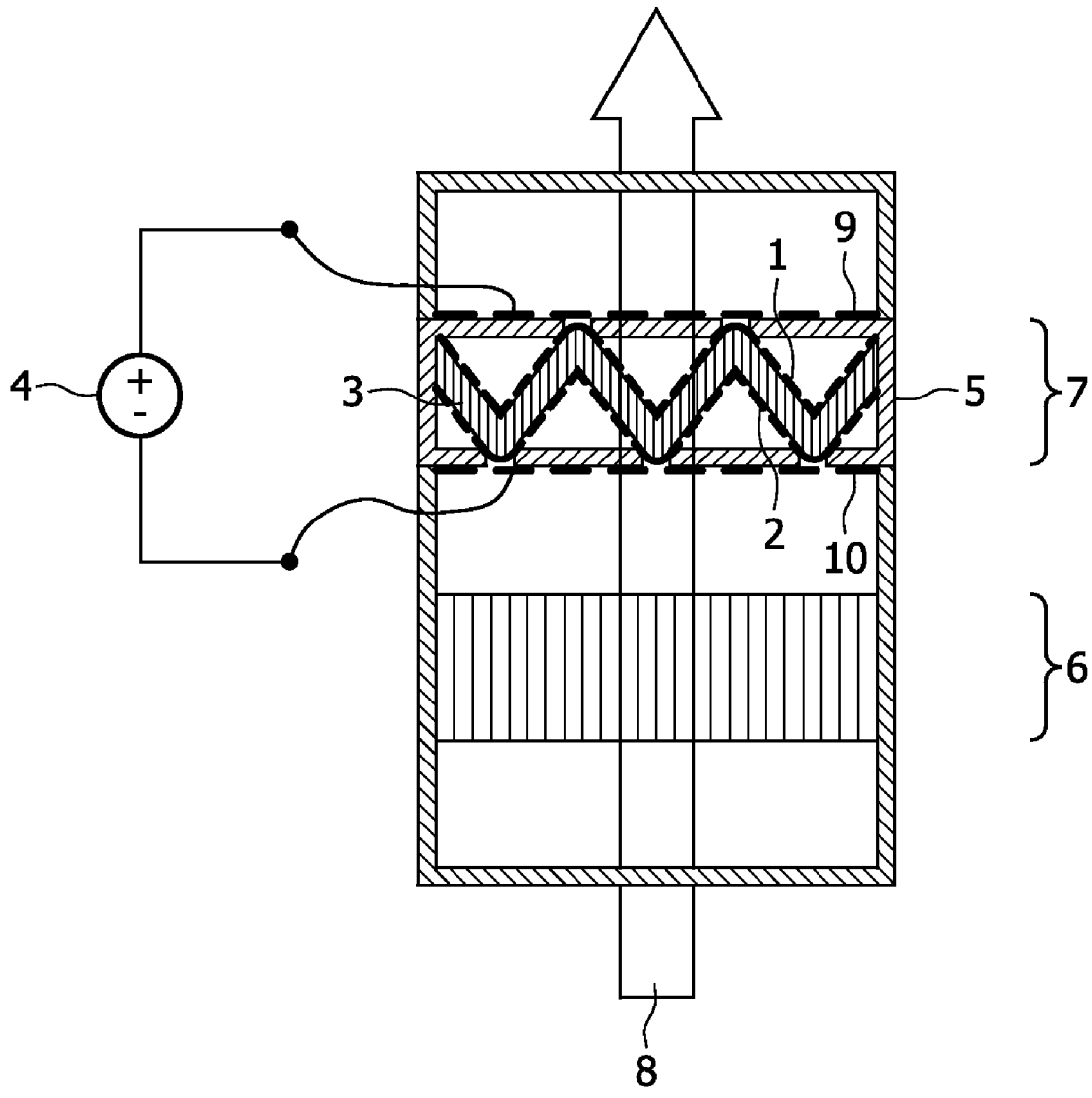
FIG. 3 is a cross section of an electrostatic filtration system comprising a particle charging section and a particle collection section, the particle collection section comprising the electrostatic particle filter according to the invention.

FIG. 3 shows a modified version of the embodiment shown in FIG. 2, in which the particle collection section 7 comprises a third electrode 9 and a fourth electrode 10. The third electrode 9 and the fourth electrode 10 are not enclosed in the casing 5 that comprises the electrostatic particle filter. In such an arrangement, the third electrode 9 and the fourth electrode 10 serve as interconnects between the power supply 4 and the first electrode 1 and the second electrode 2, respectively. For example, the electrostatic particle filter has a pleated shape and the third electrode 9 and the fourth electrode 10 are plane metal grids that contact the first electrode 1 and the second electrode 2 at each protruding tip of the pleats.

EXAMPLE 1

An electrostatic particle filter according to the invention is manufactured as follows. Two polyester gauzes having a porosity of about 50%, a thickness of 160 μm, and a pore size of 200 μm×200 μm are dip-coated using an aqueous solution comprising potassium formate ($KHCO_2$, 0.01 g/ml), potassium bicarbonate ($KHCO_3$, 0.04 g/ml), polyvinyl alcohol (0.01 g/ml), and Alconox (a surfactant manufactured by Alconox, Inc., 0.01 g/ml), followed by drying in air, resulting in each polyester gauze having a sheet resistance of $5 \cdot 10^9$ Ohm per square at a relative humidity of 30%. Consequently, after the dip-coating process each of the polyester gauzes is a moderately-conductive electrode. The polyester gauze electrodes are laminated on the opposite sides of a filter medium. The filter medium comprises polypropylene fibers with an average fiber diameter of 20 μm. The filter medium has a thickness of about 3 mm, an area of about 625 $mm^2$, and a surface mass density of 115 $g/m^2$.

After manufacturing the electrostatic particle filter as described hereinbefore, the filter medium is strongly polluted with electrically-conductive particles from cigarette smoke. Upon applying a potential difference of 3 kV or 6 kV between the two polyester gauze electrodes, an electric field of 1 kV/mm or 2 kV/mm is established within the polluted filter medium, respectively. At a relative humidity of 50%, an electrical conduction current of 0.01 mA or 0.02 mA is measured to flow through the polluted filter medium upon applying a potential difference of 3 kV or 6 kV between the two polyester gauze electrodes, respectively.

Next, an air flow having a velocity of 0.6 m/s and comprising charged sodium chloride (NaCl) particles is directed through the polluted electrostatic particle filter. The filtration efficiency of the electrostatic particle filter is measured as a function of particle diameter and magnitude of the electric field within the filter medium.

Figure 4:
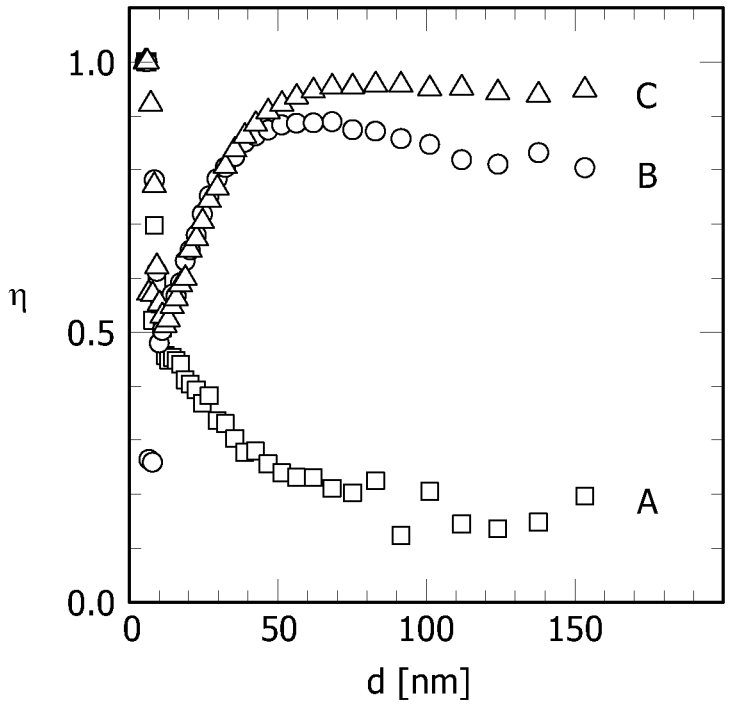
FIG. 4 contains the results of measurements performed at a relative humidity of 0% of the fractional filtration efficiency η as a function of particle diameter d (in nm) for an electrostatic particle filter according to the invention, of which the filter medium is strongly polluted with electrically-conductive particles from cigarette smoke.
Figure 5:
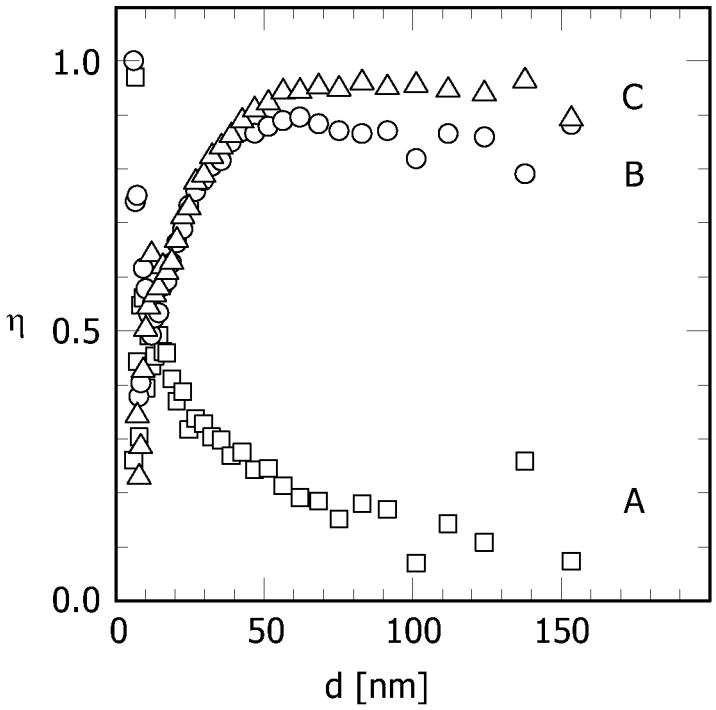
FIG. 5 contains the results of measurements performed at a relative humidity of 50% of the filtration efficiency fractional η as a function of particle diameter d (in nm) for an electrostatic particle filter according to the invention, of which the filter medium is strongly polluted with electrically-conductive particles from cigarette smoke.

FIG. 4 and FIG. 5 contain the results of the measurements performed at a relative humidity of 0% and 50%, respectively. The fractional filtration efficiency (11) is measured at a magnitude of the electric field of 0 kV/mm (data sets A, represented by squares), 1 kV/mm (data sets B, represented by circles), and 2 kV/mm (data sets C, represented by triangles). In FIG. 4 and in FIG. 5, the fractional filtration efficiency ($\eta$) is plotted as a function of the particle diameter (d) in nm.

By comparing the filtration efficiency obtained at zero electric field (data sets A) to the filtration efficiency obtained at non-zero electric field (data sets B and C), it is clear that the filtration efficiency of the polluted electrostatic particle filter is electrostatically augmented, even at a relative humidity of 50%.

Electrostatic augmentation of the filtration efficiency of an electrostatic particle filter that is strongly polluted with electrically-conductive particles, at a relative humidity of 50%, does not occur when the electrostatic particle filter is not arranged to allow an electrical conduction current through the filter medium.

The invention claimed is:

1. An electrostatic particle filter for removing particles from air, the electrostatic particle filter comprising a filter medium with first and second opposite sides, a first electrode and a second electrode, the first electrode and the second electrode being permeable for an air flow containing particles, and the first electrode and the second electrode being conformally provided on the first and second opposite sides of the filter medium, respectively, characterized in that the first electrode, the second electrode, and the filter medium are arranged to allow an electrical conduction current through the filter medium, and the first electrode is a moderately-conductive electrode having a sheet resistance in a range with a lower boundary value of about $10^6$ Ohm per square and an upper boundary value of about $10^{12}$ Ohm per square, at a relative humidity of 30%.

2. An electrostatic particle filter as claimed in claim 1, wherein the second electrode is a moderately-conductive electrode having a sheet resistance in a range with a lower boundary value of about $10^6$ Ohm per square and an upper boundary value of about $10^{12}$ Ohm per square at a relative humidity of 30%.

3. An electrostatic particle filter as claimed in claim 1, wherein the lower boundary value is about $10^7$ Ohm per square and/or the upper boundary value is about $10^{11}$ Ohm per square.

4. An electrostatic particle filter as claimed in claim 1, wherein the lower boundary value is about $10^8$ Ohm per square and/or the upper boundary value is about $10^{10}$ Ohm per square.

5. An electrostatic particle filter as claimed in claim 1, wherein the moderately-conductive electrode comprises an organic compound.

6. An electrostatic particle filter as claimed in claim 5, wherein the organic compound is a hydrophilic organic compound.

7. An electrostatic particle filter as claimed in claim 1, wherein the moderately-conductive electrode comprises a doping agent.

8. An electrostatic particle filter as claimed in claim 7, wherein the doping agent is a hydrophilic doping agent or a hygroscopic doping agent.

9. An electrostatic particle filter as claimed in claim 5, wherein the filter medium comprises a hydrophobic material.

10. An electrostatic filtration system comprising a particle charging section, and an electrostatic particle filter as claimed in claim 1.

11. An electrostatic particle filter as claimed in claim 7, wherein the doping agent is a photocatalyst.

12. An electrostatic filtration system comprising a particle charging section, an electrostatic particle filter as claimed in claim 11, and a light source that is arranged to produce ultraviolet radiation for activating the photocatalyst.

* * * * *